US006736265B2

(12) United States Patent
Kipper et al.

(10) Patent No.: US 6,736,265 B2
(45) Date of Patent: May 18, 2004

(54) GENERAL MECHANIC'S TOOLBOX

(75) Inventors: Jerome Kipper, Gainesville, GA (US); Steve LaCroix Ramos, Smithfield, NC (US)

(73) Assignee: Toolbox Enterprises, Inc., Gainesville, GA (US)

( * ) Notice: Subject to any disclaimer, the term of this patent is extended or adjusted under 35 U.S.C. 154(b) by 105 days.

(21) Appl. No.: 10/028,623

(22) Filed: Dec. 20, 2001

(65) Prior Publication Data

US 2002/0117414 A1 Aug. 29, 2002

Related U.S. Application Data

(60) Provisional application No. 60/272,104, filed on Feb. 28, 2001.

(51) Int. Cl.[7] ..... B65D 85/28

(52) U.S. Cl. ..... 206/373; 206/811; 312/249.8; 312/902

(58) Field of Search ..... 206/372, 379, 206/811, 349; 312/902, 249.8, 249.11, 249.12; 220/324–326; D3/294–296, 905

(56) References Cited

U.S. PATENT DOCUMENTS 1,986,057 A * 1/1935 Hackworth ..... 220/849
2,836,288 A * 5/1958 Atchison ..... 206/89
4,303,158 A * 12/1981 Perkins ..... 206/373
4,659,154 A 4/1987 Jenkins
4,743,038 A * 5/1988 Myers et al. ..... 280/40
4,846,346 A * 7/1989 Kime ..... 206/372
4,905,857 A * 3/1990 Her ..... 220/4.22
4,911,296 A * 3/1990 Hart, Jr. ..... 206/373
5,072,852 A * 12/1991 Smith et al. ..... 220/495.09
5,102,209 A 4/1992 Hesseltine
5,193,706 A 3/1993 Hanna et al.
5,201,867 A * 4/1993 Morszeck ..... 206/316.2
5,207,723 A * 5/1993 Newby, Sr. ..... 312/249.11
5,244,265 A 9/1993 Chiang
5,482,162 A 1/1996 Dickinson
5,738,390 A 4/1998 Yemini
5,762,411 A 6/1998 Yemini
5,779,047 A 7/1998 Darrah
5,882,097 A 3/1999 Kohagen et al.
6,082,539 A 7/2000 Lee
6,193,062 B1 2/2001 Rysgaard et al.

* cited by examiner

*Primary Examiner*—Jila M. Mohandesi
(74) *Attorney, Agent, or Firm*—Hinkle & O'Bradovich, LLC

(57) ABSTRACT

A general purpose mechanics toolbox that is able to withstand external environmental conditions and abuse is disclosed. Typically, the toolbox includes a main body having a front and top cover. Tubular gaskets run between the top and front covers and the body, thereby providing a watertight seal. The body is typically constructed of a high durability plastic. The toolbox can be closed and latched with a latch mechanism that can optionally be locked.

10 Claims, 5 Drawing Sheets

GENERAL MECHANIC'S TOOLBOX

This application is a utility application claiming priority of U.S. Provisional Patent Application No. 60/272,104, filed on Feb. 28, 2001, entitled "General Mechanic's Toolbox".

STATEMENT OF UNITED STATES GOVERNMENT RIGHTS IN THE INVENTION

This invention was made with U.S. Government support under contract DAAE20-02-D-0009 awarded by the U.S. Army. The U.S. Government has certain rights in this invention.

BACKGROUND OF THE INVENTION

I. Field of the Invention

The present invention relates generally to the field of toolboxes, and more particularly to highly durable and all-weather toolbox.

II. Description of the Related Art

Many professions require toolboxes for storing tools and other tool-related equipment. Toolboxes can come in a variety of forms ranging from toolboxes that can be carried to toolboxes that can be rolled on wheels. Toolboxes can also come in a variety of materials such as plastic and metal. Often times toolboxes can be subject to extreme environmental conditions in addition to much external abuse. These conditions and abuse tend to deform and damage toolboxes. For example plastic can break or deform and metal can rust, bend or break. In addition, many toolboxes do not insulate the contents from external moisture and dust, thereby damaging expensive and valuable tools inside the toolbox.

SUMMARY OF THE INVENTION

In accordance with the present invention and the contemplated problems which have and continue to exist in this field, the invention features a general purpose mechanics toolbox that is able to withstand external environmental conditions and abuse.

In general, in one aspect, the invention features a toolbox, including a main body, a top cover connected to the main body, a front cover connected to the main body, one or more drawers located within the main body; and a seal located between the front cover and the main body and between the top cover and the main body.

In one implementation, the toolbox includes handles depressed within a portion of the main body.

In another implementation, the toolbox includes feet connected to the bottom of the main body.

In another implementation, the toolbox includes depressions on the top cover.

In another implementation, the toolbox includes a telescopic handle connected to the main body.

In another implementation, the toolbox includes wheels connected to the bottom of the main body.

In another implementation, the toolbox includes compartments located on the front cover.

In still another implementation, the toolbox includes a latch mechanism connected to the toolbox, including a latch and a latch lock.

In yet another implementation, the toolbox includes a bracket formed when the toolbox is in a closed position, the bracket having an upper portion connected to the top cover and a lower portion connected to the front cover.

In another implementation, the latch mechanism is located within the bracket.

In another implementation, the latch is pivotally connected to the upper portion of the bracket.

In another implementation, the latch lock includes a substantially J-shaped body having a long portion and a short portion, an end cap connected to the end of the long portion and a spring wrapped around the long portion and located between the end cap and the lower portion.

In another implementation, the seal includes a ridged edge connected to the top cover and a ridged edge connected to the front cover.

In another implementation, the seal further includes a gasket located with in a trench that runs along a lip of the main body and a gasket located within a trench that runs along a lip of the front cover.

In another implementation, the ridged edge of the top cover is adapted to connect with and deform the main body gasket and the front cover gasket when the toolbox is in a closed position and the ridged edge of the front cover is adapted to connect with and deform the main body gasket when the toolbox is in a closed position.

In another implementation, the seal further includes a gasket located with in a trench having an additional ridged edge oriented in opposition to the ridged edges of the top and front covers, the trench running along a lip of the main body and a gasket located within a trench having an additional ridged edge oriented in opposition to the ridged edge of the front cover, the trench running along a lip of the front cover.

In another implementation, the ridged edge of the top cover and the ridged edge in opposition are adapted to connect with and deform the main body gasket and the front cover gasket when the toolbox is in a closed position and the ridged edge of the front cover and the opposing gasket are adapted to connect with and deform the main body gasket when the toolbox is in a closed position.

In another aspect, the invention features a latch lock including a substantially J-shaped body having a long portion and a short portion, an end cap connected to the end of the long portion and a spring wrapped around the long portion and proximate the end cap.

In another aspect, the invention features a latch mechanism, including a latch having a main body having inner protrusions and an outer protrusion and a latch lock adapted to engage and interlock with the latch.

In one implementation, the latch lock includes a substantially J-shaped body having a long portion and a short portion, an end cap connected to the end of the long portion and a spring wrapped around the long portion and proximate the end cap.

In another implementation, the long portion is adapted to engage on of the inner protrusions and the short portion is adapted to engage and lock with another one of the inner protrusions.

In still another aspect, the invention features a moisture seal for a toolbox having a cover comprising a gasket running within a trench running along a lip of the toolbox, and a ridge having a tip running along a lip of the cover wherein the tip is adapted to connect with and deform the gasket and the ridge is adapted to fit into the trench, the trench having an additional ridged edge oriented in opposition to the trench ridged edge, the additional ridged edge being adapted to connect with and deform the gasket.

In yet another aspect, the invention features a shatter resistant tool box, including a main body having spherical corners and one at least one cover connected to the main body, the cover having spherical corners.

In another aspect, the invention features a storage box, including a main body, a top cover connected to the main body, a front cover connected to the main body, one or more drawers located within the main body and a sealing mechanism, including a ridged edge connected to the top cover and a ridged edge connected to the front cover, a gasket located with in a trench that runs along a lip of the main body and a gasket located with in a trench having an additional ridged edge oriented in opposition to the top cover and front cover ridges, the trench running along a lip of the main body and a gasket located within a trench having an additional ridged edge in opposition to the ridged edge of the top cover, the trench running along a lip of the front cover, wherein the ridged edge of the top cover and the opposing ridged edge are adapted to connect with and deform the main body gasket and the front cover gasket when the toolbox and a latch mechanism connected to the toolbox, including a latch and a latch lock.

In another aspect, the invention features a general purpose storage box, including a main body having one or more covers, means for creating a seal between the covers and the main body and means for connecting and locking the covers to the main body.

One advantage of the invention is that the toolbox can withstand a wide range of temperatures without becoming weakened or damaged.

Another advantage is that the invention can be dropped from a wide range of heights without sustaining any damage.

Another advantage is that the toolbox can receive a large number of high force impacts and be subject to various external motions that do not damage the toolbox or affect the contents.

Another advantage is that the toolbox is water resistant.

Another advantage is that the invention provides compact and customizable storage.

Other objects, advantages and capabilities of the invention will become apparent from the following description taken in conjunction with the accompanying drawings showing the preferred embodiment of the invention.

DETAILED DESCRIPTION OF THE INVENTION

Figure 1:
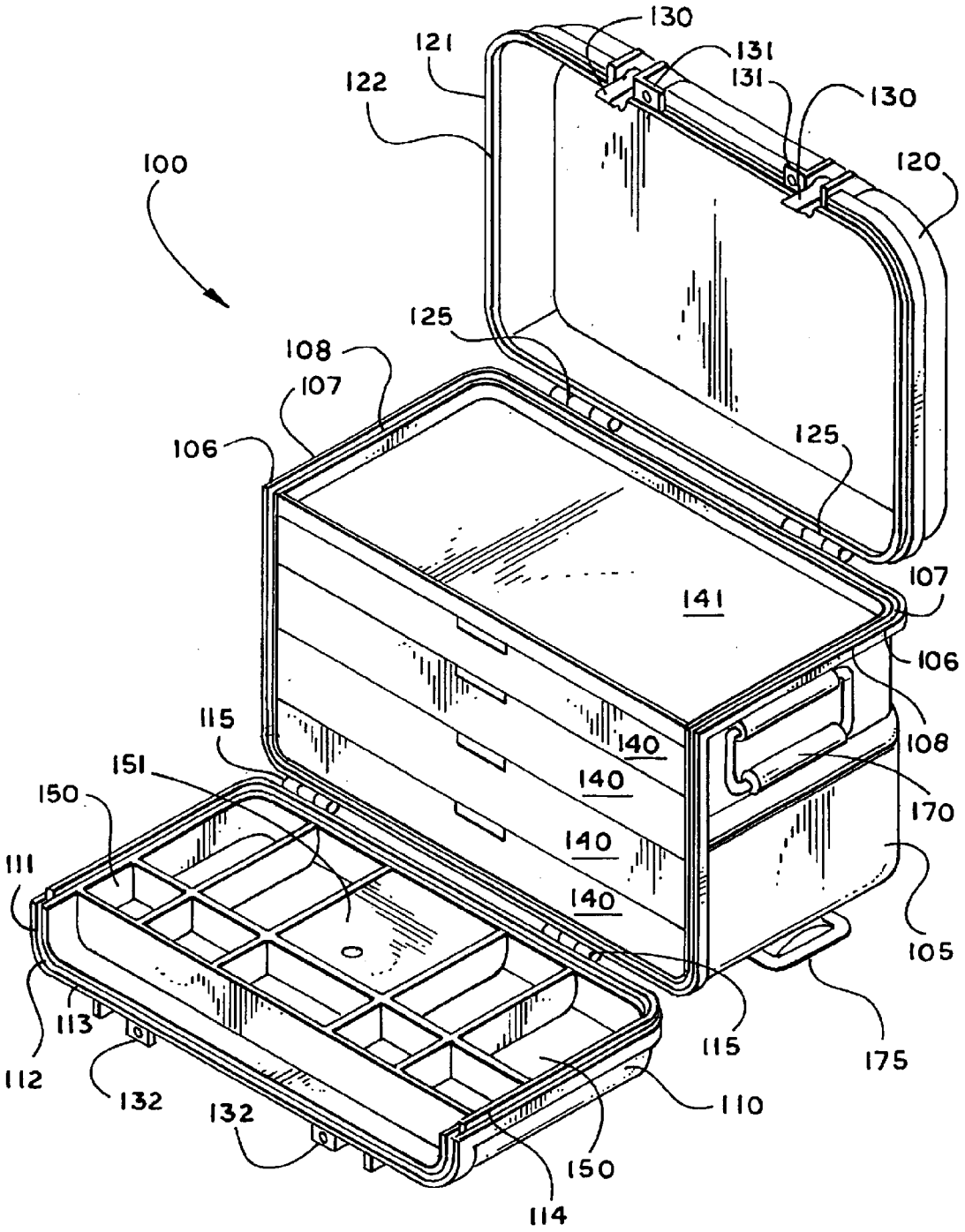
FIG. 1 illustrates perspective view of an embodiment of a general purpose mechanics toolbox in an open state.

Referring to the drawings wherein like reference numerals designate corresponding parts throughout the several figures, reference is made first to FIG. 1 that illustrates a perspective view of an embodiment of a general purpose mechanics toolbox 100 in an open state. The toolbox 100 includes a body 105 having a front cover 110 and a top cover 120. The front cover 110 is connected to the body 105 by hinges 115. The top cover 120 is connected to the body 105 by hinges 125. The body 105 can includes one or more tool drawers 140 in which various tools or other equipment can be stored. Four drawers 140 are shown contained within the body 105. However, various drawer configurations can be assembled. For example, a drawer having the depth of two of the drawers 140 can replace two of the drawers, or two such double deep drawers can replace the four drawers 140. A triple depth drawer can replace three of the drawers 140. A quadruple depth drawer can replace all four of the drawers 140. It is understood that various assemblies are contemplated in other embodiments. A flat surface 141 is typically included so that tools, other equipment or a drawer 140 can be can be laid on it. Furthermore, an additional drawer (not shown) can be laid on the surface 141 for additional storage. In such an arrangement the top cover 120 can close over the additional drawer.

The front cover 110 can include one or more compartments 150 of various sizes and depths for further storage of tools and equipment. One or more of the compartments 150 can include a hinged cover 151. When the front cover 110 is opened in this manner, it can rest on the ground because the feet (discussed below) raise the body 105 off the ground giving the front cover 110 clearance to rest and the ground without tilting the toolbox 100.

The body 105 includes a trench 107 that runs continuously along the lip 106 of the top of the body 105 and the front of the body 105. The trench 107 further includes a tubular gasket 108 within the trench 107 typically manufactured of a durable rubber material. The tubular gasket 108 can be hollow or solid and typically has a circular cross section. The tubular gasket 108 is rigid but deformable and resilient. The tubular gasket 108 runs continuously along the continuous trench 107.

The front cover 110 includes a trench 112 that runs on the lip 111 of the front cover 110. The trench 112 is not continuous like trench 107. The trench 112 includes a length of tubular gasket 113 similar to the tubular gasket 108 described above. Typically the tubular gasket 113 runs slightly off from the edges of the trench 112. The front cover also includes ridged edge 114 that runs along the inner edge of the front cover 110. Similarly, the top cover 120 includes a ridged edge 122 that runs the entire lip 121 of the top cover 120.

The toolbox 100 further includes latches 130 connected to the front part of the top cover 120. The latches 130 are adapted to connect and lock with the front cover 110 as described further below. The locking mating pairs 131, 132 are adapted to line up so that a padlock can optionally be used to lock the top and front covers 110, 120 to each other when they are in a closed position thereby locking the interior of the body 105.

The toolbox 100 further includes handles 170 on either side of the toolbox 100. The handles 170 are typically recessed within the body 105 so that when they are not in use they are protected from glancing blows and the like. The handles 170 are typically spring-loaded so that when they are not engaged by a user, they retract within the recesses on the body 105.

An additional handle 175 runs along the bottom of the toolbox 100. The handle 175 is described further below.

Figure 2:
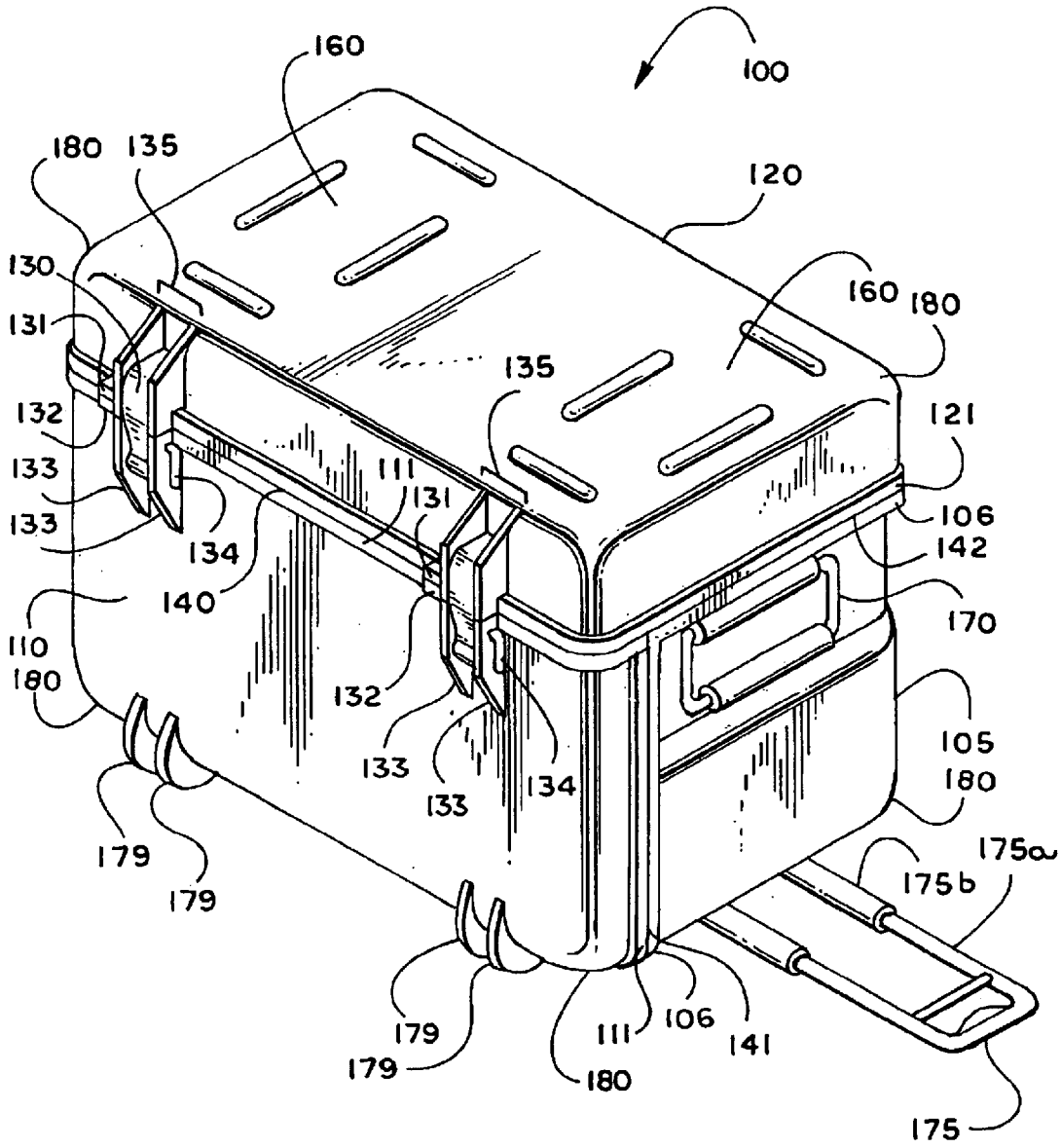
FIG. 2 illustrates perspective view of an embodiment of a general purpose mechanics toolbox in a closed state.

FIG. 2 illustrates a perspective view of an embodiment of a general purpose mechanics toolbox 100 in a closed state. The toolbox 100 includes the main body 105 having the front cover 110 and the top cover 120. The covers 110, 120 are shown interconnected by one or more latching mechanisms 135. The latching mechanism 135 includes a bracket section 133 that is formed when the top cover 110 and front cover 110 are in contact. The latch 130 is held within the bracket and is locked into position with a latch lock 134. The latching mechanism 135 is described in further detail below.

When in the closed state, the toolbox 100 is sealed from outer environmental conditions. One seal 140 is formed between the lip 111 of the front cover 110 and the lip 121 of the top cover 120 when the toolbox 100 is in the closed state. Another seal 141 is formed between the lip 106 of the main body 105 and the lip 11 of the front cover 110. Another seal 142 is formed between the lip 121 of the top cover 120 and the lip 106 of the main body 105. All of the seals 140, 141,142 are formed when the top and front covers 110, 120 are closed. As is further discussed below, the latching mechanism 135 aids in creating the water resistant seals 140, 141, 142.

The toolbox 100 also includes feet (shown below). The feet typically raise the body 105 of the toolbox 100 a distance from the ground and provide support for the toolbox 100. The toolbox 100 also includes depressions 160 on the top surface of the top cover 120. The depressions 160 are adapted to receive the feet of another toolbox so that various toolboxes can be stacked. The depressions 160 prevent lateral sliding motion of stacked toolboxes.

The handle 175 is shown in a further extended position than in FIG. 1. The handle 175 includes an elongated C-shaped bar 175*a* in a telescopic arrangement with tabular bodies 175*b*. The C-shaped bar 175*a* can extend and retract out of the tubular bodies 175*b* to make the handle 175 longer and shorter as needed.

The toolbox 100 also includes protrusions 179 on the front cover 110. The protrusions 179 are discussed in further detail below.

The corners 180 of the toolbox 100 are typically spherically constructed which is described further below. The spherical shape contributes to the high durability of the toolbox 100. It has been experimentally determined that the spherical construction of the corners 180 allows the corners 180 to withstand the largest amount of external forces, impulses, stresses and other related physical interactions on the corners 180. For example, if the toolbox 100 is dropped on one of the corners 180, the forces are most efficiently dissipated along the surface of the sphere that is formed into the corners 180.

Figure 3:
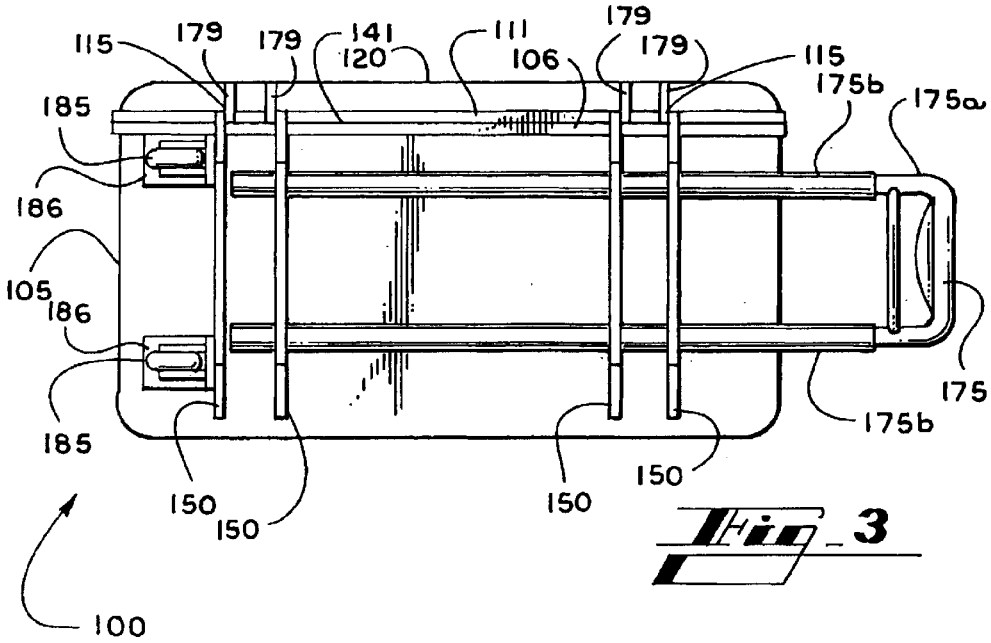
FIG. 3 illustrates a bottom view of an embodiment of a general purpose mechanics toolbox.

FIG. 3 illustrates a bottom view of an embodiment of a general purpose mechanics toolbox 100 in the closed state. The main body 105 includes the feet 150 as mentioned above. The feet 150 are generally constructed in pairs and can be placed along the understood of the main body 105 as needed. The tubular bodies 175*b* intersect the feet 150 and run along the length of the main body 105. The C-shaped body 175*a* is shown retracted into the tubular bodies 175*b*. Wheel brackets 186 having wheels 185 are connected at one end of the main body 105 near one of the feet 150.

The protrusions 179 connected to the front cover 120 are interconnected to the feet 150 forming the hinges 115 that connect the front cover 120 and the main body 105. As mentioned above, the toolbox is in the closed state thereby forming the seal 141 between the lip 111 of the front cover 120 and the lip 106 of the main body 105.

Figure 4:
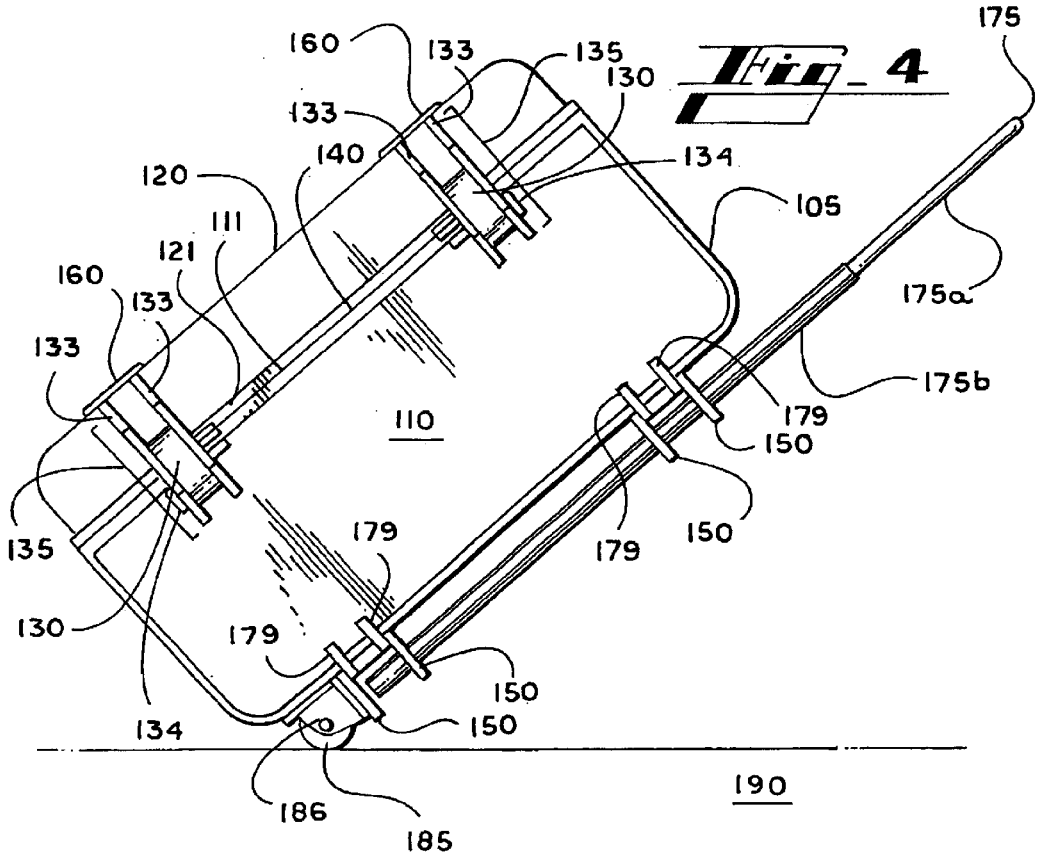
FIG. 4 illustrates a side view of an embodiment of a general purpose mechanics toolbox.

FIG. 4 illustrates a side view of an embodiment of a general purpose mechanics toolbox 100 in a closed state. The lip 121 of the top cover 120 is in contact with the lip 111 of the front cover 110 forming the seal 140. The latching mechanism 135 including the bracket section 133, the latch 130 and the latch lock 134, is engaged. From the side view, the depressions 160 on the top cover 120 are shown. The side view of the feet 150 are also shown. The tubular body 175*b* runs through the feet 150 along the length of the main body 105. The C-shaped body 175*a* is extended from the tubular body 175*b*. In this arrangement, the tool box 100 can be angled with respect to the ground 190. At this angle the wheels 185 can be used to easily move the toolbox 100. When desired, the toolbox 100 can then be laid on the ground 190 on the feet 150. The C-shaped body 175*a* can be retracted back into the tubular body 175*b*, and the toolbox 100 can be opened and used.

The Latch Mechanism Embodiment

A description of the latch mechanism 135 is now discussed. FIGS. 5A–5D illustrate several views of an embodiment of a latch mechanism 135.

Figure 5A:
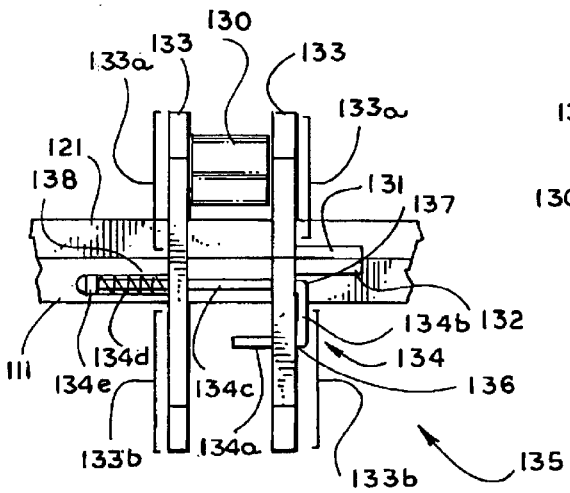
FIGS. 5A–5D illustrate several views of an embodiment of a latch mechanism having an embodiment of a latch lock.

FIG. 5A illustrates a close up view of an embodiment of a latch mechanism 135. The latch mechanism 135 includes a bracket section 133 that is formed when the tool box 100 is closed and lips 111, 121 are in contact with one another. The bracket includes an upper portion 133*a* and a lower portion 133*b*. The latch 130 is held within the upper portion 133*a* of the bracket 133. The latch 130 is pivotally connected to the upper portion 133*a* of the bracket 133 and is shown in an open and unlocked position. FIG. 5A also illustrates the locking mating pairs 131, 132. The latch lock 134 is held within the lower portion 133*b* of the bracket 133. The latch lock 134 is typically a "J" shape, including a short portion 134*a*, a long portion 134*c*, substantially parallel to the short portion 134*a* and a middle portion 134*b* connected to and substantially perpendicular to the short and long portions 134*a*, 134*c*. A spring 134*d* is wrapped around the outer end of the long portion 134*c*. An end cap 134*e* is connected to the end of the long portion 134*c*. The spring 134*d* is positioned between the end cap 134*e* and the lower portion 133*b* of the bracket 133. The latch lock 134 is therefore spring loaded within the lower portion 133*b* of the bracket 133. The short portion 134*a* intersects one of the lower portions 133*b* through a hole 136. The long portion 334*c* intersects on the lower portions 133*b* through a hole 137 and the other lower portion 133*b* through a hole 138.

Referring still to FIG. 5A, the latch lock 134 typically has two positions. The first position is the neutral (engaged) position as pictured in FIG. 5A. In the neutral position, the spring 134*d* is extended, the short portion 134*a* protrudes within the bracket 133 in between the two lower portions 133*b* and the middle portion 134*b* rests against one of the lower portions 133*b* of the bracket 133. The latch 130 is shown in an open position in FIG. 5A. However, the neutral position of the latch lock 134 typically locks the latch 130 in the closed and locked position as discussed below with respect to FIG. 5D.

Figure 5B:
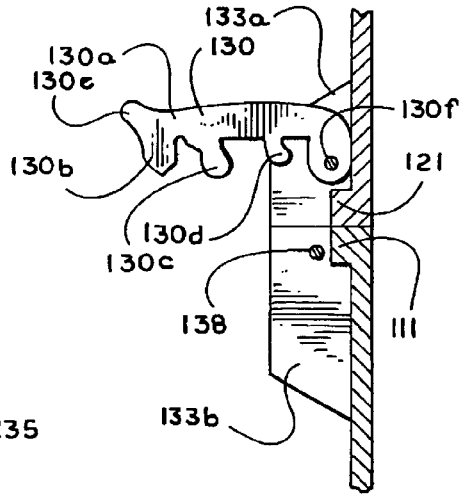

FIG. 5B illustrates a side view of the latch mechanism 135 in the open and unlocked position. The mechanism 135 is shown with one of the brackets 133 removed for ease of discussion. The bracket 133 is formed with the upper and lower portions 133*a*, 133*b* and the upper and lower lips 111, 121 in contact with each other respectively. One of the holes 138 is shown in the lower portion 133*b*. The latch 130 is pivotally connected to the upper portion 133*a* of the bracket 133 by hinge pivot 130*f*.

Referring still to FIG. 5B the latch 130 includes a main body 130*a* and three inner protrusions 130*b*, 130*c*, 130*d*. The latch 130 also includes an outer protrusion 130*e*. The first inner protrusion 130*b* is typically a locking edge, the second inner protrusion 130*c* is typically a connection edge and the third inner protrusion 130*d* is typically a rest edge. The outer protrusion 130*e* is typically a user grip.

Figure 5C:
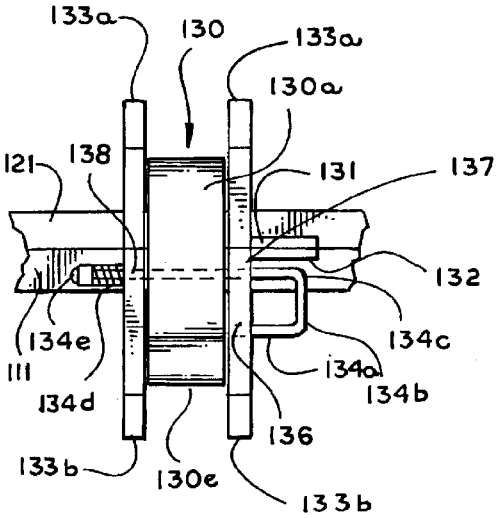

FIG. 5C illustrates a close up view of an embodiment of a latch mechanism 135 in a closed and locked position. The latch 130 is secured within the bracket 133. The latch lock 134 is shown in a loaded position. In this loaded position, the spring 134*d* is contracted, the short portion 134*a* does not protrude within the bracket 133 and the middle portion no longer rests against one of the lower portions 133*b* of the bracket 133. The loaded position is typically attained when a user applies a force against the end cap 134*e*. Although the latch is fully secured within the bracket 133, it is not yet locked when the latch lock 134 is in the loaded position. The long portion 134*c* is partially shown in phantom behind the latch 130 and through the holes 137, 138. The hole 136 is also shown in phantom.

Figure 5D:
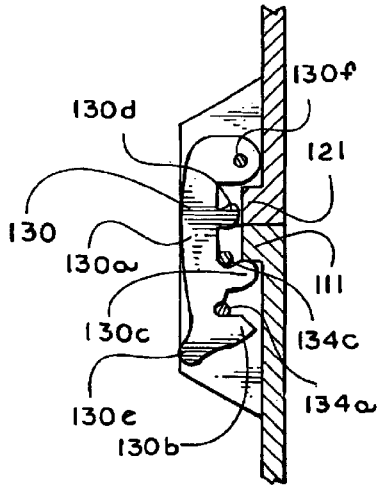

FIG. 5D illustrates a side view of the latch mechanism 135 in the closed and locked position. The protrusion 130*d* rests against lip 121. The protrusion 130*c* is engaged with the long portion 134*c*. The protrusion 130*c* also engages the lip 111. The protrusion 130*b* is engaged with the short portion 134*a*. The latch lock 134 in the neutral position. In the neutral position, the short portion 134*b* is engaged with the protrusion 130*b*. When the latch lock 134 is in the loaded position, the protrusion 130*b* and the short portion 134*a* are not engaged. It is the engagement between the protrusion 130*b* and the short portion 134*c* that locks the latch 130 within the bracket 133. In both the neutral position and the loaded position, the long portion 134*c* is engaged with the protrusion 130*c*. There is typically enough flexibility so that the protrusion 130*c* can slide over the long portion 134*c* when forces are applied at the outer protrusion 130*e*. This ability of the protrusion 130*c* to slide over the long portion 134*c* allows a secure fit of the latch 130 into the bracket before the latch lock 134 is put into the neutral position thereby locking the latch 130 into place within the bracket 133. Furthermore, when the protrusion 130*c* engages both the long portion 134*c* and the lip 111, tighter seals are created at seals 140, 141, 142 (see FIG. 2).

Toolbox Seal Operation

Figure 6A:
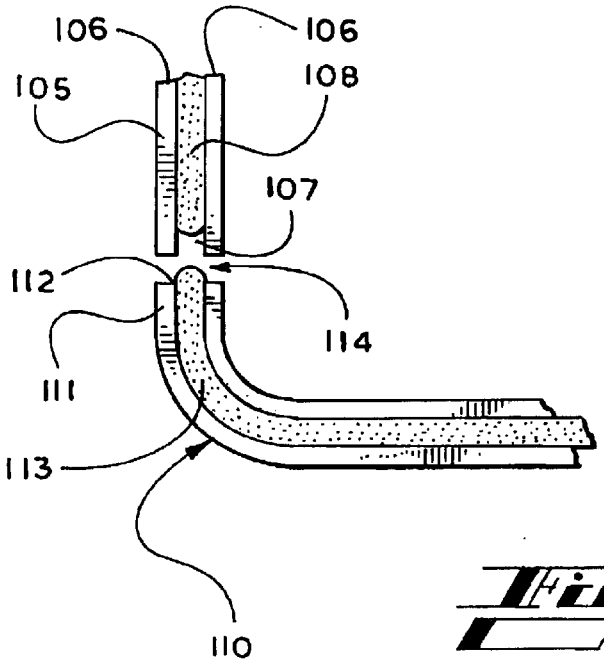
FIG. 6A illustrates a view of two gaskets within trenches.

FIG. 6A illustrates a top view of a portion of the main body 105 and front cover 110. In the main body 105, the gasket 108 is within the trench 107 that runs the length of lip 106. In the front cover 110, the gasket 113 is within the trench 117 that runs along the lip 111. However, the gasket 113 protrudes from the trench 112. When the toolbox is closed and the front cover 110 is closed against the main body, the protruding part of the gasket 113 overlaps with the gasket 108 and the trenches 107, 112 meet with each other, effectively creating a continuous gasket and trench.

Referring again to FIG. 1, the toolbox 100 can be closed by first by closing the front cover 110 which pivot about hinges 115. When the front cover 110 is closed in this manner, the ridged edge 114 comes into contact with the portion of the tubular gasket 108 in trench 107 on the front of the body 105. The ridged edge 114 begins to deform that part of the gasket 108 in trench 107 thereby creating a water resistant seal.

Next, the top cover 120 is closed by pivoting the cover 120 about hinges 125. When the top cover 120 is closed the ridged edge 122 comes into contact with the portion of the tubular gasket 108 in trench 107. The ridged edge 122 begins to deform the tubular gasket 108 in trench 107 thereby creating a water resistant seal. Furthermore, the ridged edge 122 also comes into contact with the tubular gasket 113 that is in trench 112 and deforms it creating a water resistant seal in that area. The ridged edge 122 also pushes the protruding portion of the gasket 133 against the gasket 108 further creating a seal between the gaskets 108, 113.

As described above, the seals 140, 141, 142 are enhanced when the latch mechanisms 135 are locked. When the latch mechanisms 135 are locked into place, the ridged edges 114, 122 are pushed deeper into their respective tubular gaskets 108, 113 creating a further seal, virtually locking out all external moisture as well as dust and other foreign matter. This air tight quality, along with a low density material used in the manufacturing of the toolbox 100 allows the toolbox 100 to float in most circumstances.

Figure 6B:
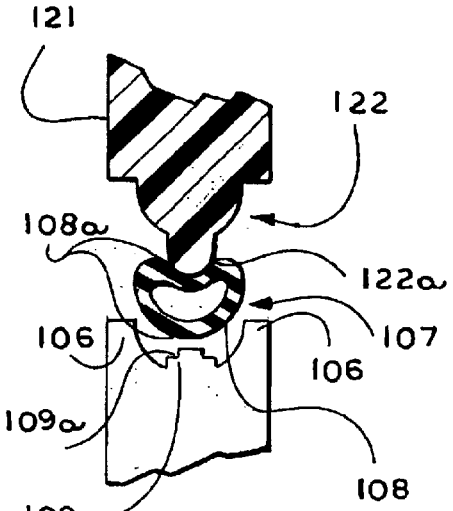
FIG. 6B–6C illustrate ridge and gasket configurations.
Figure 6C:
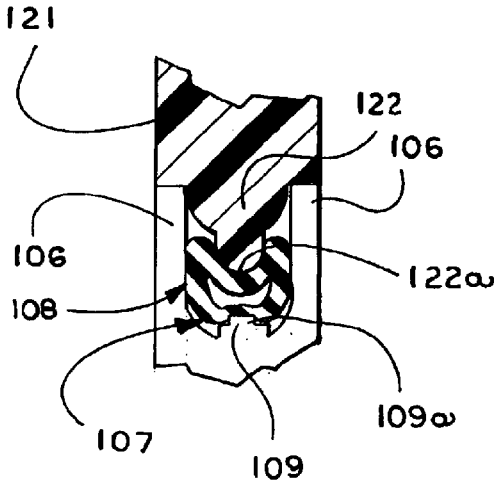

The above descriptions discussed the gasket and ridged edge configurations responsible for creating the water resistant and foreign matter resistant seal. FIG. 6B–6C illustrate the ridge edge 122 and gasket 108 on the top cover 120 and main body 105 respectively. The ridged edge 122 and gasket 108 are representative of the other ridged edges and gaskets on the toolbox.

FIG. 6B illustrates a close up cross-sectional view of the ridged edge 122 on lip 121 in proximity to and slightly deforming the gasket 108 within the trench 107 formed within the lip 106. The ridged edge 122 includes a tip 122*a*. The gasket 108 is shown hollow. In other embodiments the gasket 108 can be solid. When the toolbox 100 is closed and locked, the seal is formed. FIG. 6B further illustrates an additional ridged edge 109 having a tip 109*a* and located within the trench 107, and oriented in opposition to the ridged edge 122. The tips 109*a*, 122*a* are adapted to engage with the gasket at seal points 108*a*. The trench 107 can have a generally concave cross section adapted to receive the gasket 108 having a particular diameter. In an implementation, the gasket 108 is typically connected to the trench 107 with glue or other suitable adhesive.

FIG. 6C illustrates a close up and cross-sectional view of the ridged edges 109, 122 and gasket 108 when the toolbox 100 is closed. In this arrangement, the lips 106, 121 meet and the ridged edge 122 fits into the trench 107 in a male-female arrangement. In addition, the tips 109*a*, 122*a* deform the gasket 108 at seal points 108*a*. Typically, the gasket 108 is also deformed in such a way that parts of the gasket press against the interior walls of the lips 106. The meeting of the lips 106, 121, the mating of the ridged edge 122 and the trench 107 and the deformation of the gasket 108 by the tips 109*a*, 122*a* all contribute to the water and foreign matter resistant seal.

A number of embodiments have been described. Nevertheless, is will be understood that various modifications may be made without departing from the spirit and scope of the invention. Several examples are now illustrated. It is understood that the embodiments described above can be modified to be implemented in other used other than a toolbox. For example, the embodiments described above can be used for any storage and utilization such as a fishing tackle box. There is no limit to the types of storage or uses for the embodiments described above.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A toolbox, comprising:

a main body;

a top cover connected to the main body;

a front cover connected to the main body;

one or more drawers located within the main body; and a seal located between the front cover and the main body and between the top cover and the main body;

a latch mechanism connected to the toolbox, the latch mechanism including a latch and a latch lock, the latch lock comprising:

a substantially J-shaped body having a long portion and a short portion;

an end cap connected to the end of the long portion; and a spring wrapped around the long portion and located between the end cap and the lower portion;

a bracket formed when the toolbox is in a closed position, the bracket having an upper portion connected to the top cover and a lower portion connected to the front cover;

wherein the latch mechanism is located within the bracket and wherein the latch is pivotally connected to the upper portion of the bracket.

2. The toolbox as claimed in claim 1, further comprising handles depressed within a portion of the main body.

3. The toolbox as claimed in claim 1, further comprising feet connected to the bottom of the main body.

4. The toolbox as claimed in claim 1, further comprising depressions on the top cover.

5. The toolbox as claimed in claim 1, further comprising a telescopic handle connected to the main body.

6. The toolbox as claimed in claim 1, further comprising wheels connected to the bottom of the main body.

7. The toolbox as claimed in claim 1, further comprising compartments located on the front cover.

8. A toolbox, comprising:

a main body;

a top cover connected to the main body;

a front cover connected to the main body;

one or more drawers located within the main body; and a seal located between the front cover and the main body and between the top cover and the main body, wherein the seal includes a ridged edge connected to the top cover and a ridged edge connected to the front cover; and wherein the seal further includes a gasket located with in a trench having an additional ridged edge oriented in opposition to the ridged edges of the top and front covers, the trench running along a lip of the main body and a gasket located within a trench having an additional ridged edge oriented in opposition to the ridged edge of the front cover, the trench running along a lip of the front cover.

9. The toolbox as claimed in claim 8, wherein the ridged edge of the top cover and the ridged edge in opposition are adapted to connect with and deform the main body gasket and the front cover gasket when the toolbox is in a closed position and the ridged edge of the front cover and the opposing gasket are adapted to connect with and deform the main body gasket when the toolbox is in a closed position.

10. A storage box comprising:

a main body;

a top cover connected to the main body;

a front cover connected to the main body;

one or more drawers located within the main body; and a sealing mechanism, including:

a ridged edge connected to the top cover and a ridged edge connected to the front cover;

a gasket located with in a trench having an additional ridged edge oriented in opposition to the top cover and front cover ridges, the trench running along a lip of the main body and a gasket located within a trench having an additional ridged edge in opposition to the ridged edge of the top cover, the trench running along a lip of the front cover, wherein the ridged edge of the top cover and the opposing ridged edge are adapted to connect with and deform the main body gasket and the front cover gasket when the toolbox is in a closed position and the ridged edge of the front cover and the opposing ridged edge are adapted to connect with and deform the main body gasket when the toolbox is in a closed position; and a latch mechanism connected to the toolbox, including a latch and a latch lock.

* * * * *